United States Patent [19]

Schwab

[11] Patent Number: 4,822,959

[45] Date of Patent: Apr. 18, 1989

[54] ELECTRICAL SWITCH HAVING A SNAP-ACTING SWITCH ELEMENT

[75] Inventor: Pierre P. Schwab, Port St. Lucie, Fla.

[73] Assignee: Schwab-Koplin Assoc., Inc., Port St. Lucie, Fla.

[21] Appl. No.: 147,748

[22] Filed: Jan. 25, 1988

[51] Int. Cl.[4] ..... H01H 13/14

[52] U.S. Cl. ..... 200/5 A; 200/290; 200/409; 337/365

[58] Field of Search ..... 200/5 A, 67 D, 159 B, 200/159 A, 340, 67 DA, 67 DB, 83 P, 290; 337/365, 390, 89, 53, 380, 379, 343

[56] References Cited

U.S. PATENT DOCUMENTS

| | | | |
|---|---|---|---|
| 2,361,193 | 10/1944 | Gray | 297/15 |
| 2,624,819 | 1/1953 | Spina et al. | 200/67 DA X |
| 2,629,791 | 2/1953 | Tourneau | 200/67 D X |
| 3,909,768 | 9/1975 | Woods | 200/284 X |
| 4,751,351 | 6/1988 | Lambke | 200/67 D |
| 4,760,221 | 7/1988 | Yoshida et al. | 200/67 D |

FOREIGN PATENT DOCUMENTS

| | | | |
|---|---|---|---|
| 360223 | 6/1938 | Italy | 337/379 |

*Primary Examiner*—A. D. Pellinen
*Assistant Examiner*—Morris Ginsburg
*Attorney, Agent, or Firm*—Lloyd L. Zickert

[57] ABSTRACT

A switch element including a ribbon-type spring member having a plurality of interconnected inner and outer loops and stressed to cause the member to take a substantially dome-shaped configuration and the loops to store a predetermined amount of energy. The spring member is made of electrically conductive material, and adapted to coact with contacts to open and close a circuit and to define a snap-acting function for the element that may be used for monostable or bistable switch operation.

25 Claims, 4 Drawing Sheets

FIG. 11
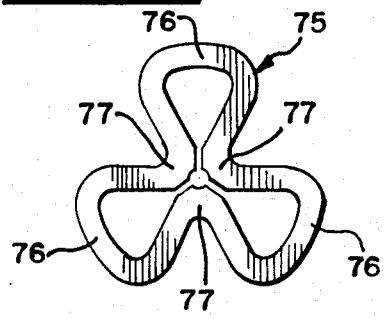
FIG. 12
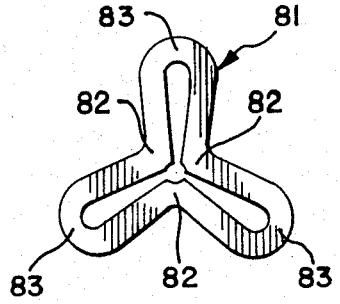
FIG. 9
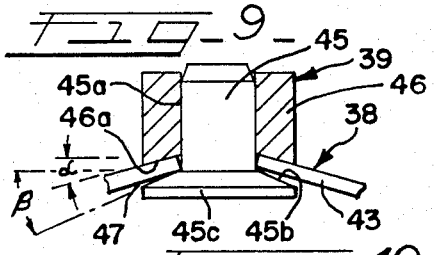
FIG. 13
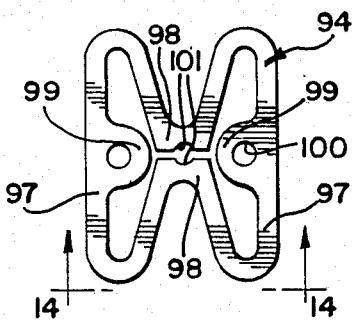
FIG. 10
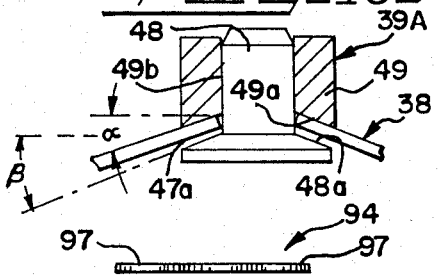
FIG. 14
FIG. 16
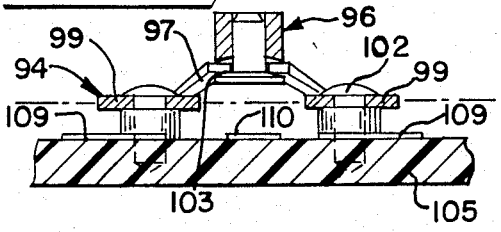
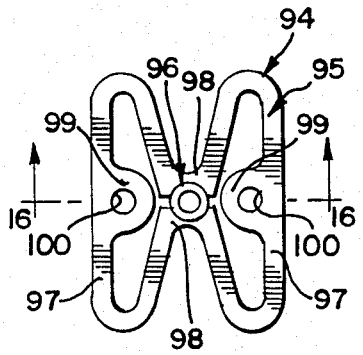
FIG. 15
FIG. 17
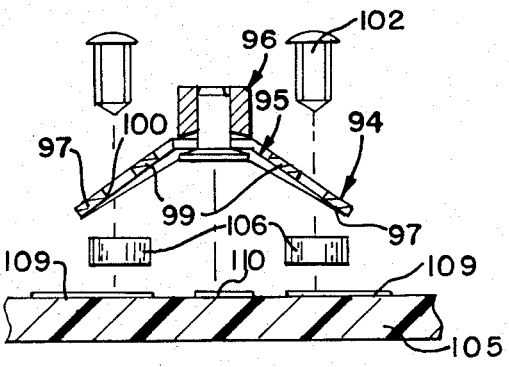

ELECTRICAL SWITCH HAVING A SNAP-ACTING SWITCH ELEMENT

DESCRIPTION

This invention relates in general to a snap-acting switch element capable of being used for monostable or bistable switch operation, and more particularly to a snap-acting switch element that when used for monostable operation will provide an especially good tactile feel, and still more particularly, to a snap-acting switch element capable of being adjusted to change its snap-acting characteristics.

BACKGROUND OF THE INVENTION

Heretofore, it has been well known to provide snap elements for electrical switching operation. Dome-shaped snap elements for switches, such as disclosed in U.S. Pat. Nos. 3,710,209; 3,751,612; 3,967,084; 4,029,916; and 4,083,100, are particularly well known. Each of these patents shows a snap-acting element that is dome-shaped and which may have one or more feet. These patents also show it is old to use plural elements in keyboards. Further, these snap-acting elements are monostable in that they will only take one position when not subjected to any force and whereby once depressed by a force they will return to the original position when the force is released. Obtaining appropriate tactile feel in these elements is always a problem.

The dome snap-acting elements known heretofore are formed of relatively thin stock and are formed in a dome-shaped configuration whereby they collapse upon being depressed and then return to their original shape once the collapsing force has been removed.

Many of the dome-shaped snap-acting elements heretofore known are more particularly in the form of a rigid dome-shaped structure when generally becomes increasingly stiff or inelastic as the dome diameter is decreased for a given material thickness. Accordingly, the characteristics of such a dome snap-acting element are not particularly suitable for miniaturization of switching elements, which is a trend in the industry.

Many keyboards are designed to have a flush face where no visible keys can be discerned and where only a flat surface with printed key indicia is visible and accessible to the operator. Where dome switches are used in such configurations, it is often necessary to additionally include secondary snap means to enhance the tactile feel. Such secondary means causes additional expense in the manufacture of the keyboard. Minimal tactile feel is particularly apparent in small size dome snap elements where the thickness of the material of the dome is so thin that no meaningful tactile feel can be experienced. Increasing the thickness of the material tends to cause a loss of elasticity and snap action. This is particularly noticeable as the size of the dome switches decrease in diameter.

It is also well known that dome snap-acting elements are not considered to be true overcenter snap elements. A true overcenter snap device is bistable, wherein it must snap from one stable position to another stable position. Thus, conventional dome snap-acting elements, being monostable, cannot serve as bistable elements. Only a momentary function such as closing of an electrical circuit can be produced by such dome switches. For example, in a thermal switch that has opened an electrical circuit due to malfunction caused by overheating, it is desirable to maintain that open position unil the problem causing the malfunction has been corrected. Thus, dome snap-acting elements cannot properly serve as a bistable switch element.

It is also known that dome snap-acting elements cannot oppose more than a few ounces of force to a snapping-over action as the material forming the dome must be very thin so that it can acquire acceptable snap-acting characteristics.

It is known that the environment under which some keyboards are used require the use of gloves which may insulate completely against a snap-acting tactile feel of heretofore known dome switch elements, that thereby decrease their usefulness.

Dome snap-acting elements heretofore known must be mechanically deformed and stressed in order to acquire the desired snap-acting properties. Precise deformation of the material for these elements is difficult to obtain, thereby limiting the control over the degree and uniformity of stressing and ultimate tactile feel characteristics. Further, major tooling costs are required for each change in size of dome snap-acting elements and desired snap force.

Prior known small bimetallic snap discs are unable to snap and operate in response to small temperature differentials, thereby limiting their use as a low differential thermal control device. Indeed, snap-acting elements of heretofore known types are essentially stiff and rigid in construction and have very little useful elasticity. They therefore do not function well, if at all, in light of small changes in ambient temperatures.

It is sometimes necessary to provide "buffer" circuits to properly condition the momentary electrical pulse resulting from the depressing of heretofore known snap-acting dome switches. The need for such circuits is caused by the normal differential in human depressing forces to a key structure whereby the electrical pulse generated may be of different durations.

SUMMARY OF THE INVENTION

The present invention overcomes the heretofore known difficulties experienced in dome snap-acting elements and provides an improved snap-acting switch element having a high degree of elasticity and configured such that the diameter or size may be significantly reduced without sacrificing elasticity or tactile feel. The snap-acting switch element of the present invention includes a generally disc-shaped planar spring member having a plurality of interconnected inner and outer loops, and means for stressing the loops and deforming the element to a substantially dome shape. Preferably, the means for stressing the loops and deforming the element include an activating member centrally mounted on the spring member.

Both the disc-shaped member and the activating member may be precisely made to provide precision operation. The activating member may be suitably sized to provide the desired force requirement of operating the element and will also serve as an electrical contact for the snap-acting element. Thus, changing the size of the activating member for a given spring member will adjust the snap-acting characteristics. Both the disc-shaped member and the activating member are made of suitable electrical conductive material and a material having a desired elasticity and memory quality. Depending upon the environment on which the snap-acting element is used, the activating member will be made for producing monostable or bistable operation.

For momentary contact and closing of circuits, it will be used in a monostable fashion, and for thermal responsive switches it may be used in a bistable arrangement. The shape of the loops may very depending upon the desired characteristic of the snap-acting elements. It will be understood that the disc-shaped member is first formed by stamping, etching or otherwise and takes a planar shape. The activating member would then be mounted centrally of the disc-shaped element for stressing the loops and for causing the disc-shaped member to attain a generally dome-shaped configuration.

It is therefore an object of the present invention to provide a new and improved snap-acting switch element that may be used for monostable or bistable operation.

A further object of the present invention is to provide a snap-acting switch element including a flexible planar member having a plurality of interconnected inner and outer loops, and means for stressing the loops and deforming the element to take a substantially dome shape.

It is another object of the present invention to provide a snap-acting switch element that may be easily adjusted to provide a desired snap-acting characteristic and which includes a disc-shaped member of flexible electrically conductive material having a plurality of inner and outer loops that are interconnected and an activating member coacting with the inner loops to stress the disc-shaped member or energize the member by stressing the loops.

Another object of the present invention is to provide a snap-acting switch element that produces excellent tactile feel, and which includes a disc-shaped spring member and an activating member, whereby varying the size of the activating member will vary the tactile feel and required force for operation.

Still a further object of the present invention is in the provision of a new and improved snap-acting switch element that will provide a desired snap-acting characteristic so that it will give a desired tactile feel during operation.

A still further object of the present invention is to provide a snap-acting switch element that may be made of bimetal material and responsive to small temperature differentials caused by electrical current levels or ambient temperature changes, and therefore operate as a circuit breaker or an electrical cutoff protection device.

A still further object of the present invention is to provide a new and improved snap-acting switch element for electrical switches having essentially clean electrical make-and-break characteristics with only a few milliseconds of contact, chatter or bounce, and which operates essentially free of any air resistance.

Other objects, features and advantages of the invention will be apparent from the following detailed disclosure, taken in conjunction with the accompanying sheets of drawings, wherein like reference numerals refer to like parts.

BRIEF DESCRIPTION OF THE DRAWINGS

FIG. 9 is a greatly enlarged detail view of the activator of the switch of FIGS. 1 to 5;

FIG. 10 is a view similar to FIG. 9 showing a modified activator;

FIG. 11 is a modified disc-shaped spring member for a snap-acting element which differs from the member of FIG. 6 in the shape of the inner and outer loops;

FIG. 12 is another modified disc-shaped member differing in the shape of the inner and outer loops form the embodiments of FIG. 6 and 11;

FIG. 13 shows a further modified elastic member which includes only two inner and outer loops;

FIG. 14 is an end elevational view of the member of FIG. 13 looking generally along line 14—14 of FIG. 13;

FIG. 15 is a plan view of the member of FIG. 13 with an activating member in place;

FIG. 16 is a vertical sectional view taken through the snap-acting switch element of FIG. 15 substantially along line 16—16 and showing it mounted on a printed circuit board;

FIG. 17 is an exploded perspective view of the switch structure shown in FIG. 16 with the activating member mounted on the spring member;

DESCRIPTION OF THE INVENTION

Figure 1:
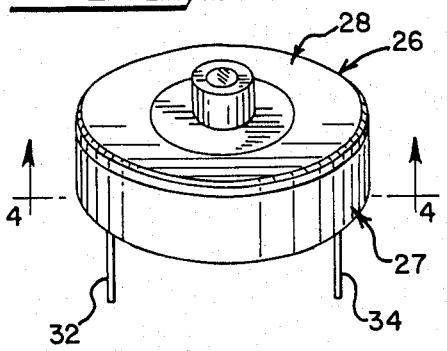
FIG. 1 is a perspective view of a snap-acting switch made according to the present invention and which includes the snap-acting element of the invention.
Figure 2:
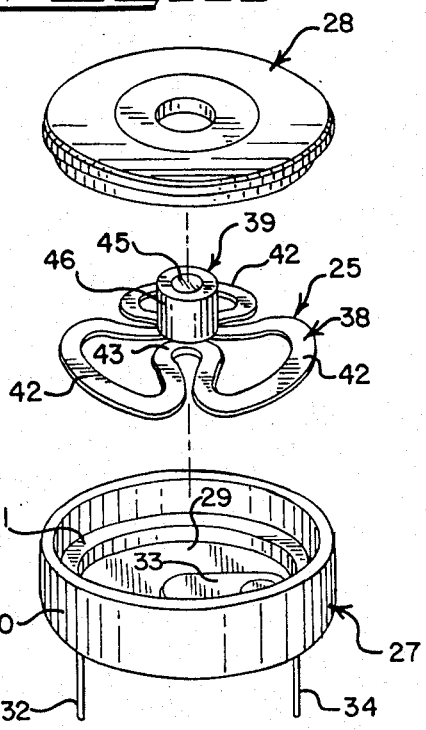
FIG. 2 is an exploded perspective view of the switch of FIG. 1.
Figure 3:
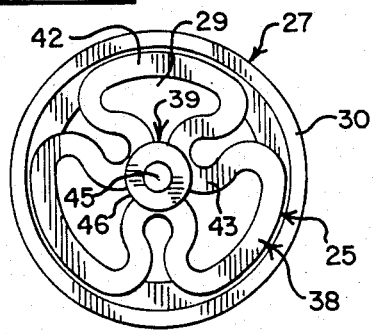
FIG. 3 is a top plan view of the switch of FIG. 1 with the cover element removed.

The snap-acting switch element of the present invention can take many forms and can be used in either monostable or bistable arrangements. Particularly, it includes a generally disc-shaped spring member of flexible material and an activating member that may be structured to coact with the spring member for monostable or bistable operation. The spring member is unique in that it includes a plurality of outer loops and a plurality of inner loops interconnected to the outer loops. The activating member is centrally mounted on the spring member and in engagement with the inner loops to stress the member a predetermined amount and thereby provide the desired force requirements for actuation. The required force to operate the spring member can be varied by varying the size of the activating member.

Referring now to the drawings and particularly to the embodiment of FIGS. 1 to 8, the snap-acting switch element of the present invention, generally designated by the numeral 25, is illustrated in a switch 26. The switch 26 includes a housing having a base 27 and a cover 28 within which the snap-acting switch element 25 is mounted. The base 27 is cup-shaped and includes a relatively flat bottom wall 29 and an upstanding cylindrical wall 30. Along the periphery of the bottom wall 29 and on a ledge spaced above the bottom wall surface, an annular electrical conductor 31 serving as one contact is suitably mounted and electrically connected to a terminal pin 32 extending outside the housing. A second electrical contact 33 is mounted on the bottom wall 29 and electrically connected to a terminal pin 34. When mounting the snap-acting switch element 25 within the bottom casing 30, the periphery of the snap-acting switch element 25 rests on the annular conductor or contact 31, as can be seen particularly in FIGS. 3 to 5. Once the snap-acting switch element 25 is mounted within the casing 30, the cover member 28 may then be suitably mounted on the base 30 in association with the snap-acting switch element to close the housing for the element and complete the switch structure, as will be more clearly described hereafter.

The unique snap-acting switch element 25 includes a disc-shaped flexible spring member 38 and an activating member 39 which is suitable structured for coacting with the disc-shaped member to produce either monostable or bistable operation and which may also be sized to provide the desired force needed for operation. Thus, the level of stress in the spring member depends on the size of the activating member. The disc-shaped member 38 is constructed as a flat or planar member, as particularly seen in FIGS. 6 and 7, which thereafter takes a dome or conical shape when the activating member 39 is mounted in position on the disc-shaped member 38, as particularly seen in FIG. 8.

Figure 6:
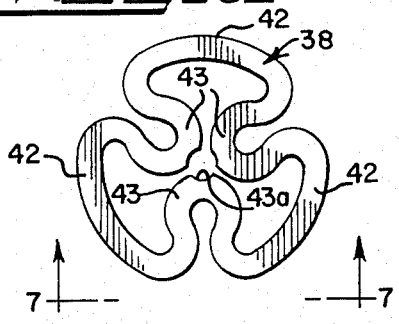
FIG. 6 is a plan view of the disc-shaped spring or elastic member of the snap-acting element used in the switch of FIG. 1.
Figure 7:
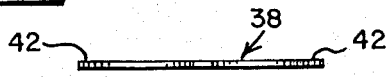
FIG. 7 is an end elevational view of the disc-shaped member of FIG. 6.
Figure 8:
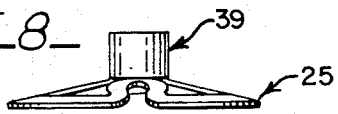
FIG. 8 is an end elevational view of the snap-acting element used in the switch of FIG. 1.

The disc-shaped spring member 38 includes a plurality of outer loops 42 and a plurality of inner loops 43 interconnected to the outer loops. The disc-shaped member 38, as seen particularly in FIG. 6, is clover-shaped. The outer loops are substantially larger inform than the inner loops. Both the inner and outer loops are spaced apart equidistantly and are circumferentially arranged. Further, it can be seen that the inner loops are generally spaced between the outer loops. For example, one inner loop is disposed between two adjacent outer loops. Likewise, one outer loop is disposed between two adjacent inner loops, all of which form a symmetrical configuration. The interconnected loops form an endless ribbon and are connected together in end-to-end fashion. The form of spring member 38 gives the maximum length of ribbon for a given diameter.

The disc-shaped member may be made of any suitable flexible electrically conductive material, as the snap-acting switch element must function as a conductive link between two contacts. Similarly,the activating member 39 must be made of an electrically conductive material since it serves as an electrical contact. For example, the disc-shaped member may be made of spring steel or beryllium copper. However, it could also be made of a flexible electrically conductive plastic, composite, metal alloy, or other suitable material. The spring member may be stamped from a sheet of material to precise dimensions, or it may be chemically etched, or it may even be cast or molded from a suitable material. While the cross section of the loops are illustrated as being rectangular, they could be circular or of any other suitable shape.

The spring member 38 includes three outer loops and three inner loops, although it should be appreciated that any suitable number could be provided. An embodiment with two inner loops and two outer loops is illustrated in FIG. 13 to 17 and will be explained in more detail hereafter. Once the disc-shaped member 38 is formed, it may be suitably treated to provide the desired spring or flexibility characteristics. It will also be appreciated that it can be made in any suitable size, although it is a feature of the present invention that it can be made in such a small size as to overcome some of the problems heretofore encountered in small size dome switches. Present day technology and market needs demand more miniaturization of parts, and the snap-acting switch element of the invention can be reduced in size to meet that demand without sacrificing integrity or performance. More particularly, where tactile feel is presently lost by small size dome snap elements, the snap-acting element of the present invention retains that tactile feel and particularly without stressing the material form which the disc-shaped member is made beyond its nature physical elastic limit.

The disc-shaped member 38 is activated or energized upon mounting the activating member 39 in engagement with the element 38. The type of activating member chosen depends upon the type of performance desired from the element 38. For example, insertion of the member 39 serves to spread the inner loops radially, thereby causing the disc-shaped member to take a dome or conical shape, as seen most clearly in FIGS. 4 and 8. Thus, the activating member 39 functions to stress the disc-shaped member and store energy that is used during its operation. This energy produces a resitance to the change of shape shown in FIG. 8 which is necessitated in order to provide a suitable function and which is caused by applying a force to the activating member.

The looped snap-acting element of the present invention undergoes essentially torsional stresses during operation. In conventional snap dome switches, the stresses during operation are essentially tensile or compressive with a moduli of elasticity more than double that of torsional stress. So, snapping of the element of the invention causes a twisting acting among the loops of the endless ribbon, which allows a greater deflection for a given size.

While the activating member may take many forms, the activating member 39 is generally in the form of a cylindrical buttom and includes a pin 45 and a sleeve 46 press fit onto the pin. The structure of the pin and sleeve is such as to define an annular groove 47, as seen most clearly in FIG. 9, that receives and coacts with the inner ends of the inner loops 43 to provide the proper function of the spring 38 as a snap-acting element. Groove 47 is defined by the cylindrical surface **45*a* of the pin 45, a frustoconical surface 45*b* of an annular flange 45*c* at the lower end of the pin,a nd a frustoconical surface 45a at the lower end of sleeve 46. The surface area of the cylindrical portion 45a of the pin 45 is substantially equal to the thickness of the spring 38. While the surfaces 45b and 46a oppose one another, they are not parallel in this embodiment. Surface 45b is inclined to the horizontal at angle $\beta$, while surface 46a is inclined to the horizontal at angle $\alpha$. In order to provide the proper functional relation between the activator and the spring where the base of the groove 47 is of a height substantially equal to the thickness of the spring 38, angle $\beta$ is greater than angle $\alpha$ so that some clearance is provided between at least one surface of the inner loops and one of the groove surfaces. As illustrated in FIG. 9, that clearance is between the bottom surface of the inner loops 43 and the surface 45b of the pin flange 45c. This clearance permits the activator to coact with the spring and allow monostable operation of the spring. It should also be appreciated that the sleeve surface 45a** must extend downwardly from the inside of the sleeve the outside, as illustrated. While angle $\beta$ is shown larger than angle $\alpha$, it should be appreciated that these angle values could be reversed and still define a clearance in the groove for the spring element.

It should be further recognized that the angle $\alpha$ may equal the angle $\beta$ where the height of the base of the groove exceeds the thickness of the spring as in the embodiment 39A shown in FIG. 10. Here also there is a clearance between at least one surface of the inner loops and one surface of the groove. More specifically, the pin and sleeve activator 39A includes a pin 48 and a sleeve 49 having opposed parallel frustoconical surface 48a and 49a, the angles of which relative to the horizontal are equal so that angle $\beta$ of the pin surface equals angle $\beta$ of the sleeve surface. That portion of the cylindrical surface 49b of the pin forming the base of the groove 47a is greater than the thickness of the inner loops of the spring 38 so as to provide a clearance which is necessary in order to obtain the monostable operation and snapping of the spring during operation. Thus, clearance for the spring may be obtained with a method used for activator 39, as well as the method used for making the activator 39A.

More specifically, the clearance in the groove for the spring for a sleeve having a wall thickness of about 0.050 inch should be a minimum of about 0.002 inch in order to allow a proper pivotal action between the spring and the activator during operation of the snap-acting element and to provide a satisfactory tactile feel. Thus, depending on the dimensions of the parts, the clearance must be sufficient so that some pivotal action will exist between the activating member and the spring.

The groove 47 of the activating member 39 as well as the groove 47a of the activating member 39A must extend downwardly and have an angle to the horizontal in the range of three to thirty degrees. Preferably, the angle should be from twelve to fifteen degrees to give a satisfactory tactile feel. Increasing the angle between the spring and the horizontal would increase the stress and the force needed to actuate the spring. Conversely, decreasing the angle will decrease the stress and force needed to actuate the spring. It will be appreciated that increasing the spreading of the inner loops will be controlled by the diameter of the inner groove wall. Increasing the diameter would increase the stressing of the spring member. During operation of the monostable switch, application of a downward force on the activator causes the spring to move past dead center and snap to close the switch. Release of the pressure allows the spring and activator to return to its home position.

In order to provide a better fit between the pin and the spring, the inner edges of the inner loops 43 are matingly formed with arcuate cutout surfaces 43a, preferably of the same radius as the outer pin surface. The arc of each cutout is of ninety degrees or more, and they are formed at the apex of the outer edges of the inner loops. The cutouts may be straight, if desired, or omitted. Assembly of the activator with the spring includes the step of driving the pin through the center of the spring, at which time the spring will take a conical shape, and then driving the sleeve onto the pin in press fit relation so that it will define the annular groove with the clearance as desired.

Figure 4:
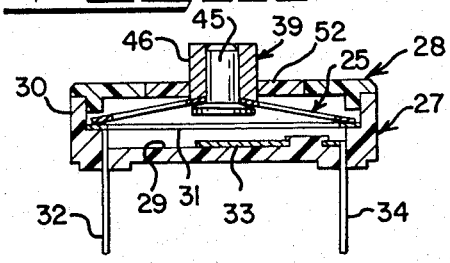
FIG. 4 is a transverse sectional view taken through the switch of FIG. 1 substantially along line 4-4 thereof and illustrating the switch in open position.
Figure 5:
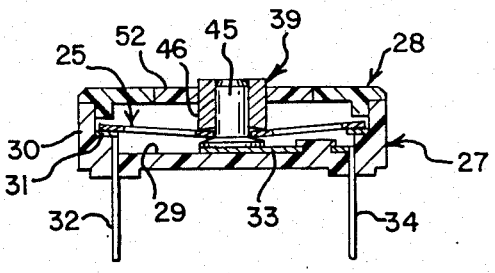
FIG. 5 is a view similar to FIG. 4 but illustrating the switch in closed position.

As seen in FIGS. 4 and 5, the contact 34 is spaced below the contact 31, the latter of which supports the periphery of the snap-acting element and is in continuous engagement therewith. Closing of the switch is accomplished by depressing the activator 39 which is in the form of a button until it causes the spring to snap through and engage the contact 33. the space between the contacts 31 and 33 is such as to cause the spring to move past horizontal or past dead center, as illustrated in FIG. 5. Thus, the spacing must be sufficient so that the snap-acting element can go past dead center in order to provide the proper tactile feel. A already mentioned, because of the shape of the groove confining the central areas of the inner loops, the snap-acting element will operate in a monostable fashion.

Referring particularly to FIGS. 1, 2, 4 and 5, it will be appreciated that the cover 28 includes a centrally disposed seal 52 having an aperture therethrough which slidably receives the activator 39. The seal 52 is composed of a suitable flexible material to mate tightly with the activator and seal along the outer surface of the activator 39 to prevent the entrance of contaminants.

It will be appreciated that the terminals 32 and 34 would be suitably connected into a circuit to be controlled by the switching action of the switch. In this regard, the switch would be normally open, and closed by depressing the activator as above mentioned.

Figure 20:
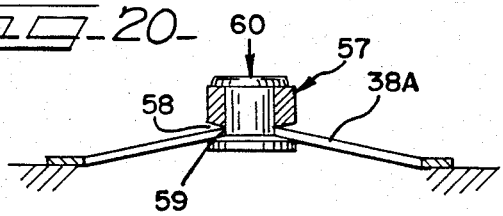
FIG. 20 is a schematic view of the snap-acting element of the present invention and showing an activating member that permit bistable operation and also illustrating the element in one of the two attainable positions.
Figure 21:
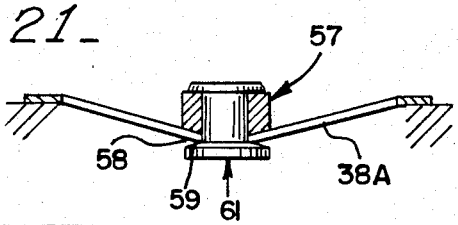
FIG. 21 is a view similar to FIG. 20 but showing the element in the other of the two attainable positions.

In order to provide bistable operation for the spring member 38, the configuration of the activating member groove receiving the inner loops is made to allow a greater pivotal action between the inner loops and the activating member. A monostable groove prevents the spring from taking more than one position when pressure is removed, while a bistable groove allows the spring to take either one of two positions. Referring particularly to the schematic views FIGS. 20 and 21, the activating member, now identified generally by the numeral 57, differs principally from the activating member 39 in that it includes an annular groove 58 of V-shape cross section having a bottom wall 59 against which the outer edges of the inner loops seat. The width of the groove at the base as shown is substantially equal to the width of the material of the inner loops, although it may be otherwise sized so long as full pivotal movement may be established between the spring members and the activating member. A pivotal point is thereby defined at the activator bottom wall 59 between the inner loops of the disc-shaped spring member 38A and the activating member. Accordingly, application of a force 60 such as to drive the activating member and cause the disc-shaped member to go overcenter, as shown in FIG. 20, will result in displacing the activating member to a second position, as shown in FIG. 21 that will be maintained once the force 60 has been removed. In order to return the activating member and disc-shaped member to the position shown in FIG. 20, it is necessary to apply a force in the opposite direction to the bottom of the activating member, such as force 61, sufficient to drive the activating member and spring member overcenter so that it will ultimately than take the position in FIG. 20.

Figure 22:
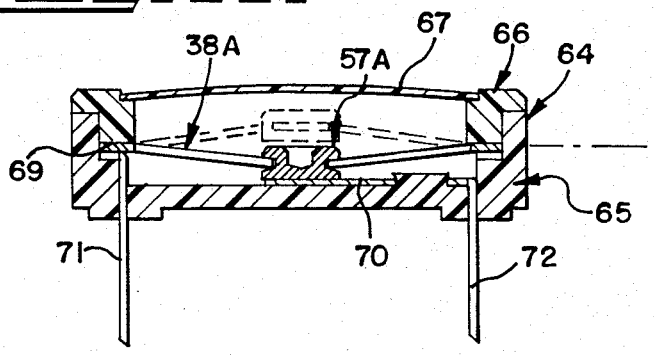
FIG. 22 is a transverse sectional view of a bistable switch according to the present invention and showing the snap-acting element in solid in the closed position and in phantom in the open position when responding to a given thermal condition.

An illustration of the use of the bistable operation is shown in the switch 64 in FIG. 22, which includes a casing 65 enclosed by a cover member 66 having a flexible top panel 67. Within the casing the snap-acting switch element of a type illustrated in FIG. 20 is mounted in association with spaced conductors or contacts 69 and 70. The periphery of the spring member 38A rests on and is in electrical contact with the conductor 69, while the activating member 57A is aligned with and when in the lower position shown by solid lines can engage the conductor 70. Contact 69 is in turn connected to a terminal pin 71, while contact 70 is connected to terminal pin 72. The terminal pins would be suitably connected into a circuit. In this embodiment, the disc-shaped member 38A would be made of a suitable bimetallic material that would respond to a temperature change and cause it to expand and release the energy stored in the snap-acting element so that it would snap from the set or closed position shown in solid lines in FIG. 22 to the unset or open position shown in dotted lines. Thus, a given current rise in the circuit or a given increase in ambient temperature would raise the temperature of the bimetallic disc-shaped member 38A and therefore be detected by the switch to cause the switch to open. It would then operate as a circuit breaker or electrical cutoff protection device. Once the temperature of the bimetallic element 38A again reaches normal, the switch can then be reset by applying a depressing force against the flexible panel 67 which would then in turn apply a force against the activating member 57 and cause the snap-acting element to take the position shown in solid lines which would close the circuit as the activating member 57 would again be in seated electrical contact with the conductor 70.

A modified disc-shaped spring member, generally designated by the numeral 75, is shown in FIG. 11, which differs from the disc-shaped spring member 38 only in the shape of the inner and outer loops. Member 75 is also generally clover-shaped and includes three outer loops 76 interconnected with three inner loops 77. The outer edges of the inner loops are suitably formed with cutouts for mating with an activating member. The outer loops 76 are not proportionally that much larger than the inner loops as in the embodiment of FIGS. 1 to 8. However, the member 75 is also capable of providing monostable and bistable operation in a similar manner to the operation of the embodiment of FIGS. 1 to 8.

Another form of disc-shaped spring member is shown in FIG. 12 and is generally designated by the numeral 81 which differs from the embodiments of FIGS. 6 and 9 only in the shape of the inner and outer loops. Member 81 includes inner loops 82 and outer loops 83 where the inner loops are larger than the outer loops. It will be appreciated that the operation will change relative to the stress created in the disc-shaped spring member when an activating member is mounted in coaction therewith but otherwise the spring member can likewise function as a monostable or bistable unit depending upon the groove configuration in the activating member employed. When relating the embodiments of FIGS. 6, 11 and 12 to one another, the embodiment of FIG. 6 will show the largest or fullest outer loops, while the embodiment of FIG. 12 shows the smallest or most closed outer loops. Thus, the embodiment of FIG. 11 shows an intermediate sized outer loop. With respect to all of these embodiments, they are snap-acting whether used in a monostable situation or a bistable situation.

While the above embodiments all include three inner and outer loops, as already mentioned, any number of inner and outer loops can be provided as long as they are of the same number. The embodiment of FIGS. 13 to 16 illustrate the use of two inner and outer loops. This snap-acting switch element is generally designated by the number 94 and includes a spring member 95 and an activating member 96 which is of the same type illustrated in FIG. 9 to produce monostable operation. The spring member 95 includes a pair of opposed and symmetrically arranged outer loops 97 and a pair of opposed and symmetrically arranged inner loops 98. The inner loops are interconnected with the outer loops and coact to define a flexible spring element capable of storing and releasing energy. The spring member 95 is also formed in the same fashion as the disc-shaped member above described in that it may be stamped from any suitable metal or alloy of metals that will give the suitable flexing characteristics, or it may be cast or molded from a suitable electrically conductive material. Where it may be formed of annealed spring steel or beryllium copper, it may thereafter be suitably heat-treated. The outer loops 97 are much larger than the inner loops 98 and may also additionally include integrally formed mounting tabs or lugs 99 having apertures 100 for receiving fastening pins 102. It will be recognized that the spring member is generally rectangular in shape, and therefore could be enclosed in a rectangularly shaped housing. However, it may be disc-shaped by rounding the outer edges of runs of the outer loops.

Energization of the spring member 95 is accomplished by mounting the activating member 96 between the two opposed inner loops 98 in the same manner above described in mounting the activating member 39 on the spring member 38. A good mating relation with the groove of the activating member is provided by arcuate cutouts 101 formed at the outer edges of the inner loops 98. These cutouts then fit and seat in the groove 103 formed in the activating member 96.

After the activating member 96 is placed in coacting relation with the spring element 95, the spring will take a dome-like shaped, as seen in FIG. 17. When the snap-acting switch element 94 is mounted in place on a support, such as the printed circuit board 105 shown in FIG. 16, and posts or pins 102 are secured to the board, the mounting tabs 99 assume a general horizontal position. In order to properly mount the snap-acting switch element 94 on the support 105 to obtain snap action by pushing past dead center, it is necessary to use spacers 106 through which the pins 102 extend as they are anchored in the printed circuit board 105 in a suitable manner. This spaces the snap-acting switch element 94 above the surface of the printed circuit board. Conductive paths 109 and 110 are provided on the printed circuit board. The paths 109 are in alignment with the spacers 106 and pins 102 since the fasteners 102 would be of a conductive material as well as the spacers 106. An electrical connection would be made between the conductive paths 109 and the snap-acting switch element 94. It will be appreciated that the conductors 109 and 110 would be suitably connected into a circuit to coact will the snap-acting switch element and provide a switch for the circuit. Thus, the snap-acting element is mounted so that the contact engaging portion of activator 96 will be in alignment with board contact 110, and it is necessary to drive the spring past dead center before contact is made, thereby causing the spring to snap and produce a tactile feel.

Upon applying depressed force to the activating member 96, it will cause the spring element 94 to be depressed to first store additional energy before it is released, and when the activating member engages the contact 110, it will close the circuit. If the groove 103 in the activating member is V-shaped as illustrated in FIGS. 20 and 21, and the spring element is bimetallic, the switch will remain closed until and if it is subjected to such a current flow or a rise in ambient temperature that would increase its temperature and cause it to expand and open. Thereafter, it would be reset when it is desired to close the circuit.

While the snap-acting element 95 is illustrated with tabs for mounting on the board arrangement, it should be appreciated that the element could be used in a housing like that shown in FIGS. 1 to 5 and appropriately shaped without needing to be secured to the board. Then the tabs would not be necessary. Likewise, the spring element of FIGS. 1 to 8 could be provided with tabs for mounting on a circuit board like FIGS. 16 and 17.

Figure 18:
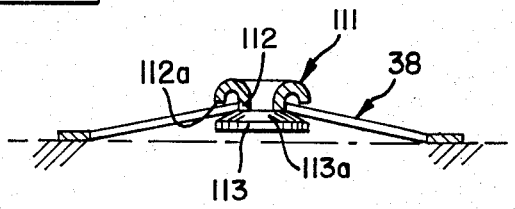
FIG. 18 is a sectional view taken through a schematic snap-acting switch element of the invention showing the element used for monostable operation and in the home position and illustrating a rivet functioning as the activator.
Figure 19:
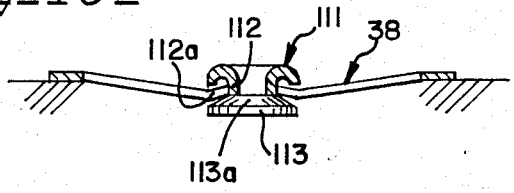
FIG. 19 is a view of the element in FIG. 18 but showing the element in the depressed position.

It may be appreciated that the activator for the spring element may take a form other than the pin and sleeve activator of FIGS. 9 and 10. Another form is shown in FIGS. 18 and 19 where activator 111 in the form of a rivet serves to stress the spring element 38. Further, the rivet is formed relative to the inner loops of the spring 38 to produce monostable operation. The rivet 111 includes a shank 112 and a head 113 having a frustoconical surface 113*a*. Application of the rivet requires bending over the shank a predetermined amount to dispose the shank edge 112a to a position that will define such clearance with the spring element as to permit such pivotal action between the activating member and the spring that the spring element will snap through dead center and produce a satisfactory tactile feel. Thus, the rivet activator will coact with the spring element to produce substantially the same operation as the pin and sleeve activator. The rivet may also be formed to define a V-groove for bistable operation.

Figure 23:
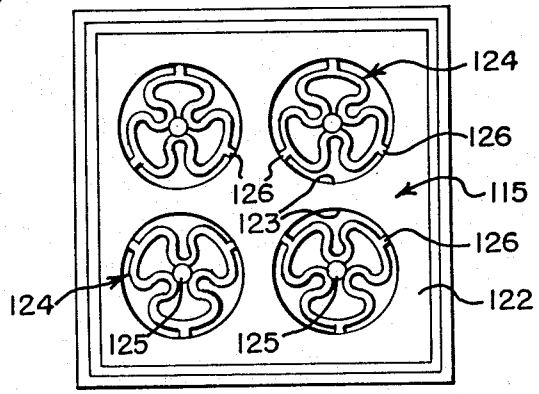
FIG. 23 is a top plan view of plural snap-acting elements in matrix form and mounted in a casing with the cover removed.
Figure 24:
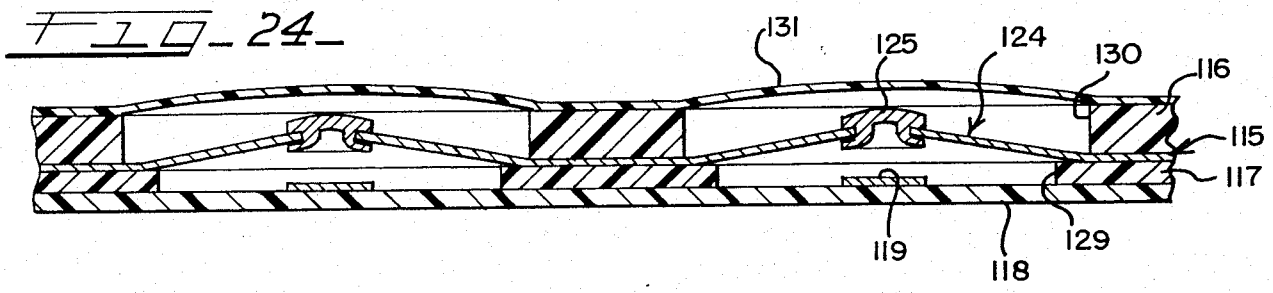
FIG. 24 is a greatly enlarged somewhat schematic cross-sectional view of the switch arrangement of FIG. 23 with the cover in place and showing the switch element in open position.

It will be appreciated that the snap-acting switch element of the present invention may be used singularly, or in multiple as with a keyboard. It should also be appreciated that the snap-acting switch element of the invention may be utilized in a matrix wherein a plurality of snap-acting elements are attached to a common frame. A matrix of such spring elements is generally illustrated in FIGS. 23 and 24 wherein the matrix of spring elements of activating members is suitably mounted in a switch housing relative to a printed circuit board for use in multiple as on a keyboard. While only four spring elements are illustrated in this embodiment, it can be appreciated that any number can be provided. The switch structure of this embodiment includes generally a matrix 115 of spring elements made of a suitable electrically conductive material and laminated between two layers or sheets of electrically insulating material 116 and 117 and all mounted on a printed circuit board 118. The printed circuit board includes conductive contacts 119 and otherwise provided conductive paths as needed. The contacts 119 would be either connected in common or to individual circuits depending upon the use desired. The matrix 115 includes a sheet of electrically conductive material 122 having a plurality of openings 123 in which spring elements 124 are disposed of a type similar to the disc-shaped member 38. thus, the disc-shaped member 124 includes inner and outer loops just line the member 38 and is also provided with an activating member 125. Each of the outer loops is integrally connected with the sheet 122 by a leg 126.

The arrangement of the openings 123 and elements 124 are aligned with openings 129 and 130 formed in the sheets of insulating material 116 and 117. Further, the activating members 125 are aligned with the contacts 119. Covering the upper sheet 116 is a firm or sheet 131 of flexible material which can be depressed and flexed to operate the spring elements and close the switches as previously described with switch 26. It will be understood that the matrix 115 is suitably connected into the circuit in which the contacts 119 are connected. Thus, momentary depressing of any one of the switch sites will close the respective circuit in which the switch site is connected. Release of pressure will allow the spring to return to home position. Thus, the spring elements in this embodiment are mounted and used for monostable operation.

While the method of stressing the spring element has been shown and described as depending upon a centrally disposed activator that fits in the center of the spring, it should be appreciated that stressing could be achieved by constraining the outer periphery of the spring ot a dimension smaller then when in the unstressed condition. This tends to apply more stress in the outer loops, but the spring element will snap through during operation. A suitable button may be mounted at the inner loops to define a contact. Further, it should be appreciated that the groove for defining monostable or bistable operation would be disposed at the periphery of the spring element and act on the periphery of the outer loops rather than the inner edges of the inner loops.

It will be understood that modifications and variations may be effected without departing from the scope of the novel concepts of the present invention, but it is understood that this application is to be limited only by the scope of the appended claims.

The invention is hereby claimed as follows:

1. A snap-acting switch element comprising, a spring member of electrically conductive material having a plurality of generally horizontally disposed outer loops and an equal plurality of generally horizontally disposed inner loops interconnected to the outer loops where the inner loops are centrally disposed of said outer loops, said interconnected loops forming an endless ribbon with the ends of the inner loops connected to the ends of the outer loops, and an activating member of electrically conductive material interposed between said inner loops and sized to spread said inner loops and energize said spring member to a desired amount by prestressing said loops and causing the inner loops to be displaced together from a plane of said outer loops such that the switch element is generally dome-shaped, said activating member serving as a switch contact, whereby said spring and activating members coact to define a snap-acting function for said switch element such that it is capable of being used of monostable or bistable switch operation.

2. The snap-acting switch element of claim 1, wherein said spring member comprises three outer and three inner loops and is disc-shaped.

3. The snap-acting switch element of claim 1, wherein said spring member comprises two outer and two inner loops and is rectangularly shaped.

4. The snap-acting switch element of claim 1, wherein said activating member includes an outwardly and downwardly extending groove coacting with said inner loops.

5. The snap-acting switch element of claim 4, wherein the groove includes upper and lower walls, one of which makes a greater angle relative to the horizontal than the other, whereby the spring member coacts with said groove to allow the spring member to have monostable operation.

6. The snap-acting element of claim 5, wherein the lower wall makes a greater angle to the horizontal than the upper wall.

7. The snap-acting switch element of claim 2, wherein said spring member is clover shaped.

8. The snap-acting switch of claim 4, wherein the groove on said activating member is rectangularly shaped in cross section and a clearance is provided between the spring member and the groove such as to permit pivotal action between the activating member and the spring member to produce a tactile feel.

9. The snap-acting switch of claim 4, wherein the groove on said activating member is V-shaped in cross section thereby coacting the spring member to produce bistable operation.

10. The snap-acting switch element of claim 1, wherein said loops are symmetrically arranged.

11. The snap-acting switch element of claim 1, wherein said outer loops are larger than said inner loops.

12. A switch comprising a housing, a pair of spaced contacts within said housing, and a snap-acting switch element in the housing in continuous engagement with one of the contacts and selectively in engagement with the outer of said contacts, said snap-acting element including a spring member of electrically conductive material having a plurality of outer loops and an equal plurality of inner loops interconnected to the outer loops, said interconnected loops forming an endless ribbon with the ends of the inner loops connected to the ends of the outer loops, said inner loops having outer edge portions and being formed an coacting to receive an activating member, and an activating member of electrically conductive material interposed between the outer edge portions of said inner loops and sized to spread said inner loops and energize sand spring member to a desired amount by prestressing said loops and causing the inner loops to be displaced together from a plane of said outer loops such that the switch element becomes generally dome-shaped, said activating member selectively engageable with the other of said contacts to electrically connect said contacts, whereby said spring and activating members coact to define a snap-acting function for said snap-acting switch element such that the switch may be used for monostable or bistable switch operation.

13. A switch as in claim 12, wherein said spring member includes three inner loops and three outer loops.

14. A switch as in claim 12, wherein said spring member includes two inner loops and two outer loops.

15. A switch as in claim 12, wherein said inner and outer loops are equidistantly spaced apart, and each inner loop is disposed between and connected to a pair of outer loops.

16. A switch as in claim 12, wherein said activating member includes an annular groove receiving the outer edge portion of said inner loops and wherein said grove includes a bottom wall seating said edge portions and spreading them to causes the inner loops to be displaced from a plane extending through the outer edge portions of the outer loops.

17. A switch as in claim 16, wherein the groove on the activating member extends downwardly and outwardly and further includes upper and lower frustoconical walls, the angle that the lower wall makes with a horizontal plane being greater than the angle between the upper wall and the horizontal so that a clearance is defined between the inner loops and one of the upper an lower frustoconical walls, said clearance being such as to allow a pivotal action between the activating member and the spring member to produce a tactile feel when the spring member snaps through dead center, whereby said switch element will produce monostable operation.

18. A switch as in claim 16, wherein the groove on the activating member is V-shaped to permit pivotal movement of the spring member in both directions, whereby said member will produce bistable operation.

19. A switch as in claim 18, wherein said spring member is bimetallic and thermally responsive to move from a closed circuit position to an open circuit position.

20. A switch as in claim 12, wherein said spring member is clover-shaped.

21. A switch as in claim 12, wherein said spring member is rectangularly shaped.

22. A switch as in claim 14, wherein the outer loops of said spring member include means for fastening said element to a support.

23. A switch as in claim 12, wherein a multiple of switch sites are provided each of which includes a snap-acting switch element.

24. A switch as in claim 12, wherein said activating member includes a pin and sleeve assembly having a pin coacting with a sleeve, the sleeve being press fit onto the pin.

25. A switch as in claim 12, wherein said activating member includes a rivet suitably formed to define a groove for the inner loops of the spring member and to have a clearance with the spring member to produce monostable or bistable operation.

* * * * *

UNITED STATES PATENT AND TRADEMARK OFFICE

CERTIFICATE OF CORRECTION

PATENT NO. : 4,822,959

DATED : April 18, 1989

INVENTOR(S) : Pierre P. Schwab

It is certified that error appears in the above-identified patent and that said Letters Patent is hereby corrected as shown below:

Col. 1, line 37, change "when" to --which--;
Col. 2, line 58, change "of" to --for--;
Col. 4, line 21, change "form" to --from--;
line 45, change "permit" to --permits--;
Col. 5, line 38, change "suitable" to --suitably--;
line 53, change "inform" to --in form--;
Col. 6, line 33, change "form" to --from--;
line 34, change "nature" to --natural--;
Col. 7, line 20, after "sleeve" insert --to--;
Col. 8, line 22, change the second occurrence of "the" to --The--
line 27, change "A" to --As--;
Col. 9, line 7, change "than" to --then--;
Col. 10, line 50, change "shaped" to --shape--;
Col. 12, line 15, change "firm" to --film--;
line 33, change "ot" to --to--;
line 67, change the second occurrence of "of" to --for--;
Col. 13, line 41, change "outer" to --other--;
line 48, change "an" to --and--;
line 52, change "sand" to --said--;
Col. 14, line 14, change "grove" to --groove--; and
line 25, change "an" to --and--.

Signed and Sealed this

Twenty-first Day of November, 1989

*Attest:*

JEFFREY M. SAMUELS

*Attesting Officer*

*Acting Commissioner of Patents and Trademarks*